US010343824B2

(12) United States Patent
Fosse

(10) Patent No.: US 10,343,824 B2
(45) Date of Patent: Jul. 9, 2019

(54) TAMPER EVIDENT CONTAINER

(71) Applicant: Lindar Corporation, Baxter, MN (US)

(72) Inventor: Daniel K. Fosse, Cambridge, MN (US)

(73) Assignee: Lindar Corporation, Baxter, MN (US)

( * ) Notice: Subject to any disclaimer, the term of this patent is extended or adjusted under 35 U.S.C. 154(b) by 0 days.

(21) Appl. No.: 15/186,033

(22) Filed: Jun. 17, 2016

(65) Prior Publication Data

US 2017/0361980 A1 Dec. 21, 2017

(51) Int. Cl.

| | |
|---|---|
| ***B65D 17/34*** | (2006.01) |
| ***B65D 43/02*** | (2006.01) |
| ***B65D 17/00*** | (2006.01) |
| ***B65D 43/06*** | (2006.01) |
| ***B65D 17/46*** | (2006.01) |
| ***B65D 17/28*** | (2006.01) |

(52) U.S. Cl.

CPC ..... *B65D 43/0235* (2013.01); *B65D 17/02* (2013.01); *B65D 17/404* (2018.01); *B65D 17/462* (2018.01); *B65D 43/06* (2013.01)

(58) Field of Classification Search

CPC .... B65D 2101/0015; B65D 2101/0092; B65D 17/20; B65D 2101/0023

USPC ..... 220/266, 270

See application file for complete search history.

(56) References Cited

U.S. PATENT DOCUMENTS

| | | | | |
|---|---|---|---|---|
| 4,986,438 | A | 1/1991 | Borst | |
| 7,073,680 | B2 | 7/2006 | Boback et al. | |
| 7,118,003 | B2 | 10/2006 | Sellari et al. | |
| 7,243,813 | B2 * | 7/2007 | Krueger | B65D 21/0219 220/571 |
| D698,241 | S | 1/2014 | Fosse | |
| 8,807,385 | B1 * | 8/2014 | Fosse | B65D 43/162 220/270 |
| 2003/0121917 | A1 | 7/2003 | Fore et al. | |
| 2008/0087669 | A2 | 4/2008 | Boback et al. | |
| 2009/0206082 | A1 * | 8/2009 | Vovan | B65D 43/0249 220/266 |
| 2010/0140267 | A1 | 6/2010 | Sellari et al. | |
| 2011/0056976 | A1 | 3/2011 | Chen | |
| 2012/0103990 | A1 | 5/2012 | McCumber | |
| 2014/0027458 | A1 | 1/2014 | Liu | |
| 2014/0209607 | A1 | 7/2014 | Fosse | |
| 2017/0283139 | A1 | 10/2017 | Fosse | |
| 2018/0093800 | A1 | 4/2018 | Fosse | |

OTHER PUBLICATIONS http://www.inlineplastics.com/safe_t_fresh.php Inline Plastics Corporation.

http://www.dartcontainer.com/web/products.nsf/files/M-204.pdf/$FILE/M-204.pdf Dart Container Corporation.

http://www.parpak.com/brochures/BreakAway-OCT10-ENG.pdf Par-Pak Corporation, Oct. 2010.

(Continued)

*Primary Examiner* — Shawn M Braden

(74) *Attorney, Agent, or Firm* — Kinney & Lange, P.A.

(57) ABSTRACT

A tamper evident closure includes a first snap, a second snap, a tear strip connected to the second snap, and a first projection extending around three sides of the first snap. In a closed position, the second snap is positioned in a cavity of the first snap, and the first projection surrounds three sides of the second snap that is positioned in the cavity of the first snap.

31 Claims, 9 Drawing Sheets

(56) References Cited

OTHER PUBLICATIONS http://www.pactiv.com/products_na/foodservice/data/PWPTamperEvident.pdf PACTIV Foodservice/Food Packaging.
http://www.pactiv.com/Products_NA/Foodservice/data/TESquares.pdf PACTIV Foodservice/Food Packaging.

* cited by examiner

TAMPER EVIDENT CONTAINER

BACKGROUND

The present invention relates to containers, and in particular, to a tamper evident design for containers.

Containers can be constructed with various structures and sizes. Two common container structures include clamshell containers and multi-piece containers. Clamshell containers are containers that mimic the form and function of a clamshell. Clamshell containers include a base portion and a cover portion that are attached to one another with a hinge. Multi-piece containers are containers that include a base portion and a cover portion that are separate pieces designed to fit together. Typically, both clamshell containers and multi-piece containers have some form of closure that is capable of holding the cover portion on the base portion when the container is closed. Different types of closures can be used, including self-locking tabs, snaps, or screw tops. Containers can also be held together with means other than closures. These means can include using frictional forces to hold container pieces together, heat sealing the container pieces together, or using staples, adhesives, or labels to hold the container pieces together.

Containers are typically secured using standard closures that allow a user to open and close the container with no consequence. Containers can also be secured with tamper evident or tamper proof closures. These types of closures include a feature that will make it obvious that the container has been opened. A container with a tamper evident or a tamper proof closure will be irreversibly altered when the container is opened for the first time.

SUMMARY

A tamper evident closure includes a first snap, a second snap, a tear strip connected to the second snap, and a first projection extending around three sides of the first snap. In a closed position, the second snap is positioned in a cavity of the first snap, and the first projection surrounds three sides of the second snap that is positioned in the cavity of the first snap.

A tamper evident container includes a first container portion, a second container portion, and a tamper evident closure. The tamper evident closure includes a first snap, a second snap, a tear strip connected to the second snap, and a first projection extending around three sides of the first snap. In a closed position, the second snap is positioned in a cavity of the first snap, and the first projection surrounds three sides of the second snap that is positioned in the cavity of the first snap.

A method includes closing a tamper evident container by bringing a first container portion into contact with a second container portion, wherein the first container portion has a first snap and the second container portion has a flange, a tear strip attached to the flange along a first perforated line, and a second snap attached to the tear strip along a second perforated line. The tear strip is folded along the first perforated line. The second snap is folded along the second perforated line. The second snap is placed in a cavity of the first snap, wherein when the second snap is in the cavity of the first snap, a projection in the first container portion surrounds three sides of the second snap.

DETAILED DESCRIPTION

Containers are used in many industries as a form of packaging for products that are commercially available. To indicate when someone has opened a package, some form of tamper evident or tamper proof means is used. A tamper evident indicator will indicate that the package has been opened, so that someone purchasing or using the product can ensure that the package includes all of the necessary contents and is safe to use.

Figure 1:
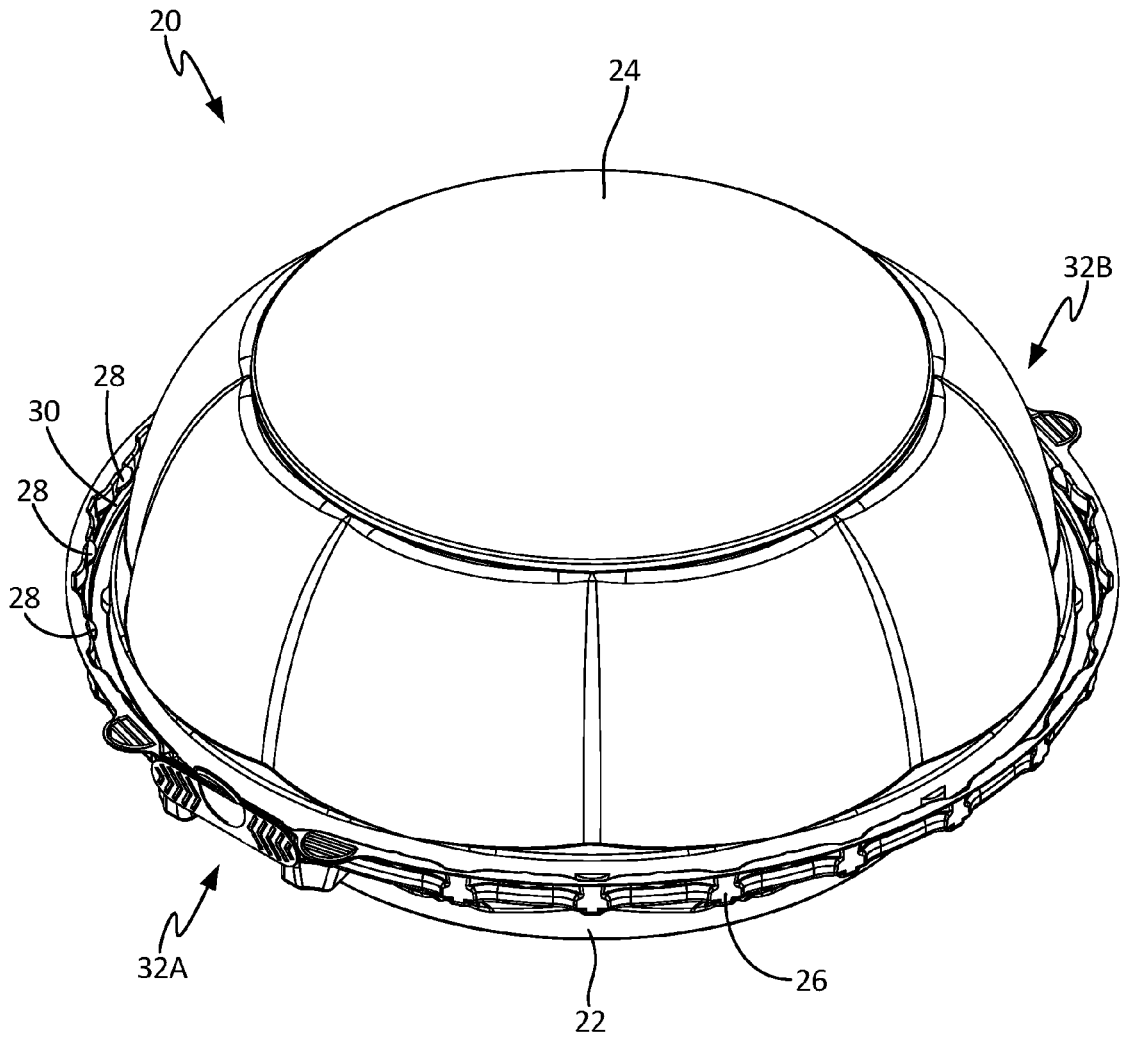
FIG. 1 is an isometric view of a tamper evident container.

FIG. 1 is an isometric view of tamper evident container 20. Tamper evident container 20 includes first container portion (base) 22, second container portion (cover) 24, rim 26, undercuts 28, rim 30, tamper evident closure 32A, and tamper evident closure 32B.

Container 20 includes first container portion 22 that forms a base of container 20 and second container portion 24 that forms a cover of container 20. First container portion 22 and second container portion 24 are separate pieces in the embodiment shown, but can be attached along a hinge in alternate embodiments. Both first container portion 22 and second container portion 24 of tamper evident container 20 are made out of plastic in the embodiment shown, but any suitable material can be used.

First container portion 22 includes rim 26 at an upper edge. Positioned around rim 26 are undercuts 28. Undercuts 28 are bumps that project inwards towards a center of first container portion 22. Second container portion 24 includes rim 30 at a lower edge. Rim 30 includes a flange that extends outward from second container portion 24. Rim 30 of second container portion 24 is sized slightly smaller than rim 26 of first container portion 22 so that rim 30 of second container portion 24 can be positioned in rim 26 of first container portion 22. Undercuts 28 on rim 26 engage rim 30 to retain second container portion 24 on first container portion 22. To remove second container portion 24 from first container portion 22, rim 26 of first container portion 22 can be pulled away from rim 30 of second container portion 24 to disengage undercuts 28 from rim 30 to allow second container portion 24 to be removed from first container portion 22. In alternate embodiments, undercuts 28 can have any suitable design that holds second container portion 24 on first container portion 22.

Container 20 further includes tamper evident closures 32A and 32B. Tamper evident closures 32A and 32B further hold container 20 in a closed position. Tamper evident closures 32A and 32B are located on opposite sides of tamper evident container 20. In alternate embodiments, tamper evident closures 32A and 32B may be located anywhere on container 20. In further alternate embodiments, container 20 can include a single tamper evident closure or more tamper evident closures.

Tamper evident closures 32A and 32B create a container that is tamper evident. To open tamper evident container 20, a user must grab and pull a tear strip on each tamper evident closure 32A and 32B away from and remove it from tamper evident container 20. When the tear strips have been removed from tamper evident container 20, a user knows that tamper evident container 20 has been opened. Once the tear strips are removed from tamper evident container 20, a user can open and close tamper evident container 20 by attaching and detaching second container portion 24 from first container portion 22 using rim 26 and undercuts 28 on first container portion 22 and rim 30 on second container portion 24. Tamper evident container 20 can be opened and closed an infinite number of times, even if tamper evident container 20 will no longer have tamper evident features after it is opened for the first time.

Figure 2A:
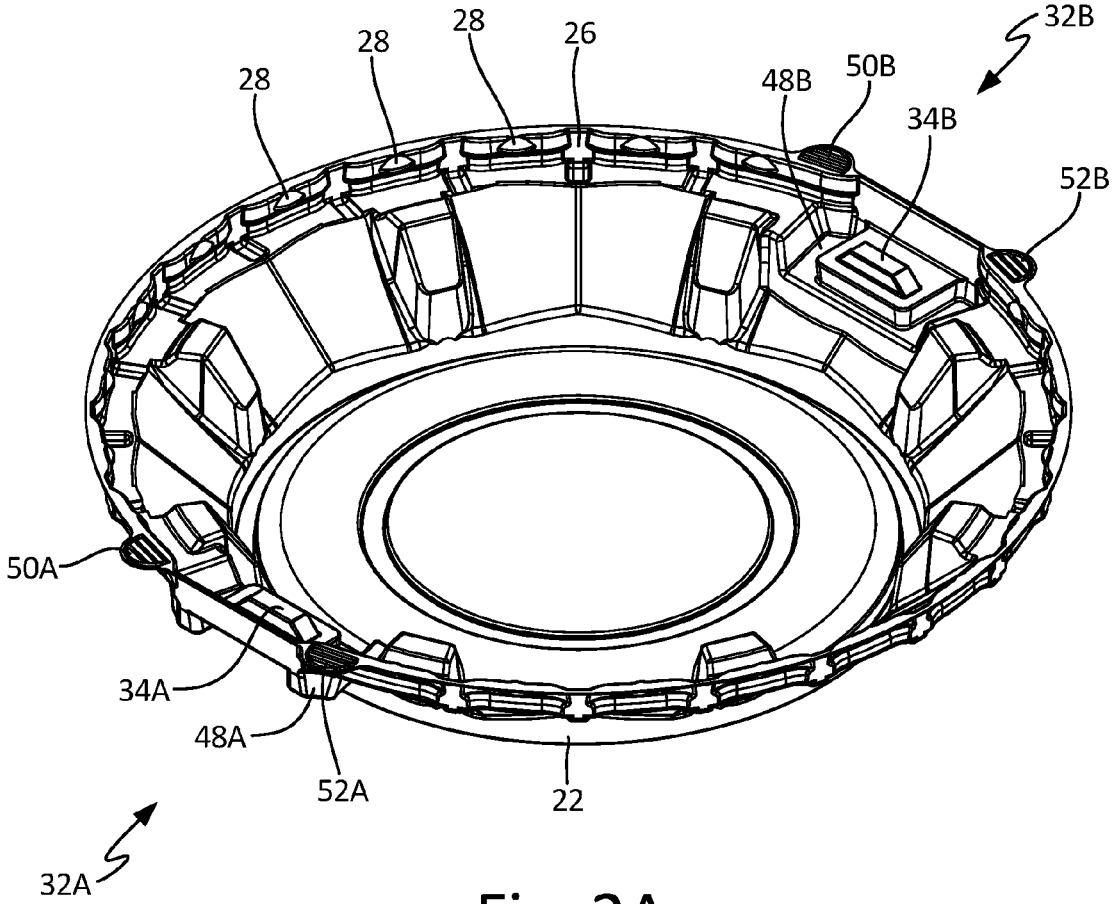
FIG. 2A is an isometric view of a first container portion of the tamper evident container.
Figure 2B:
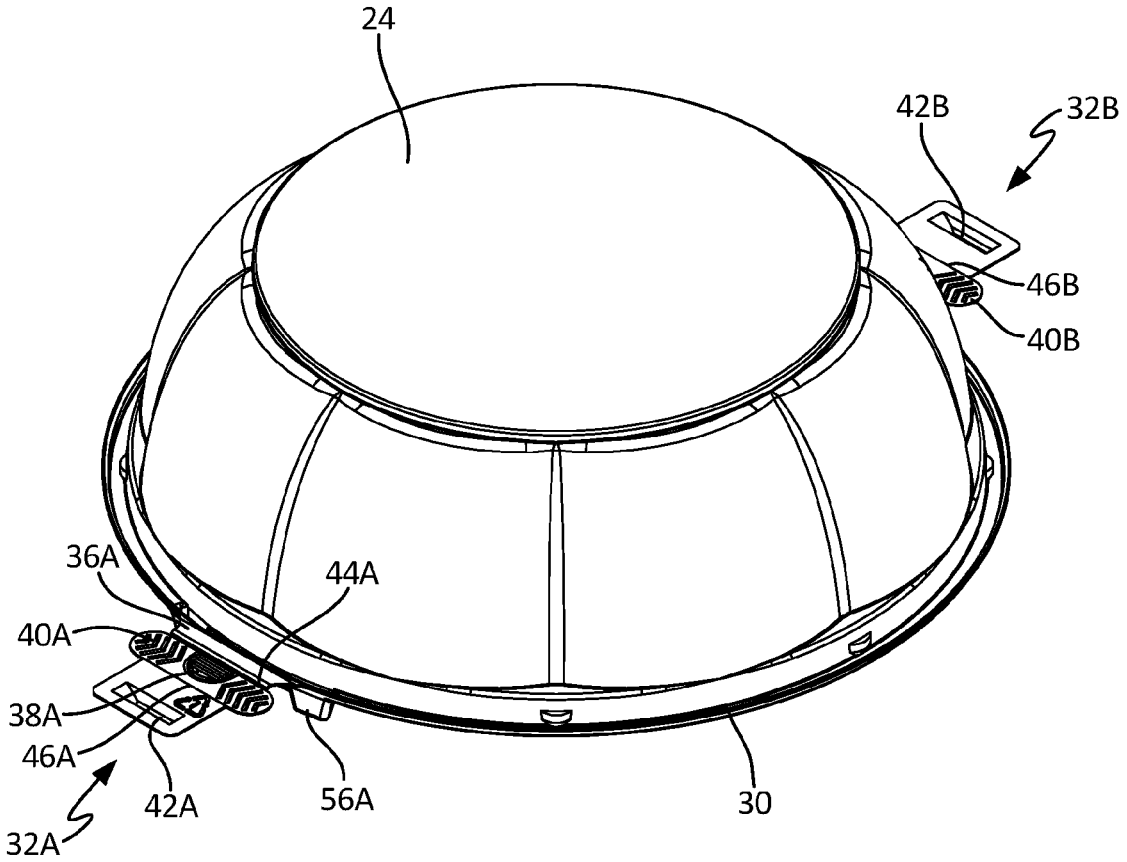
FIG. 2B is an isometric view of a second container portion of the tamper evident container.
Figure 3A:
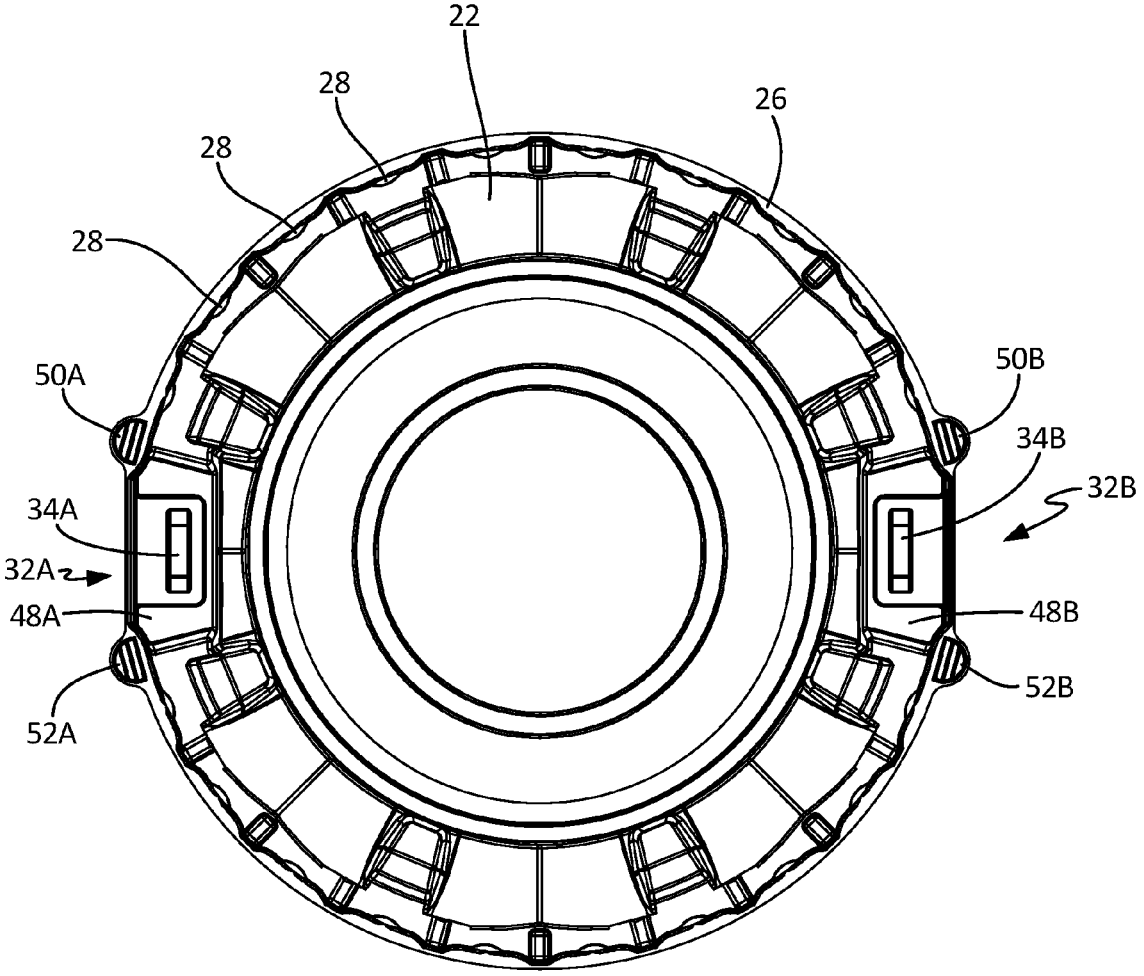
FIG. 3A is a top view of the first container portion of the tamper evident container.
Figure 3B:
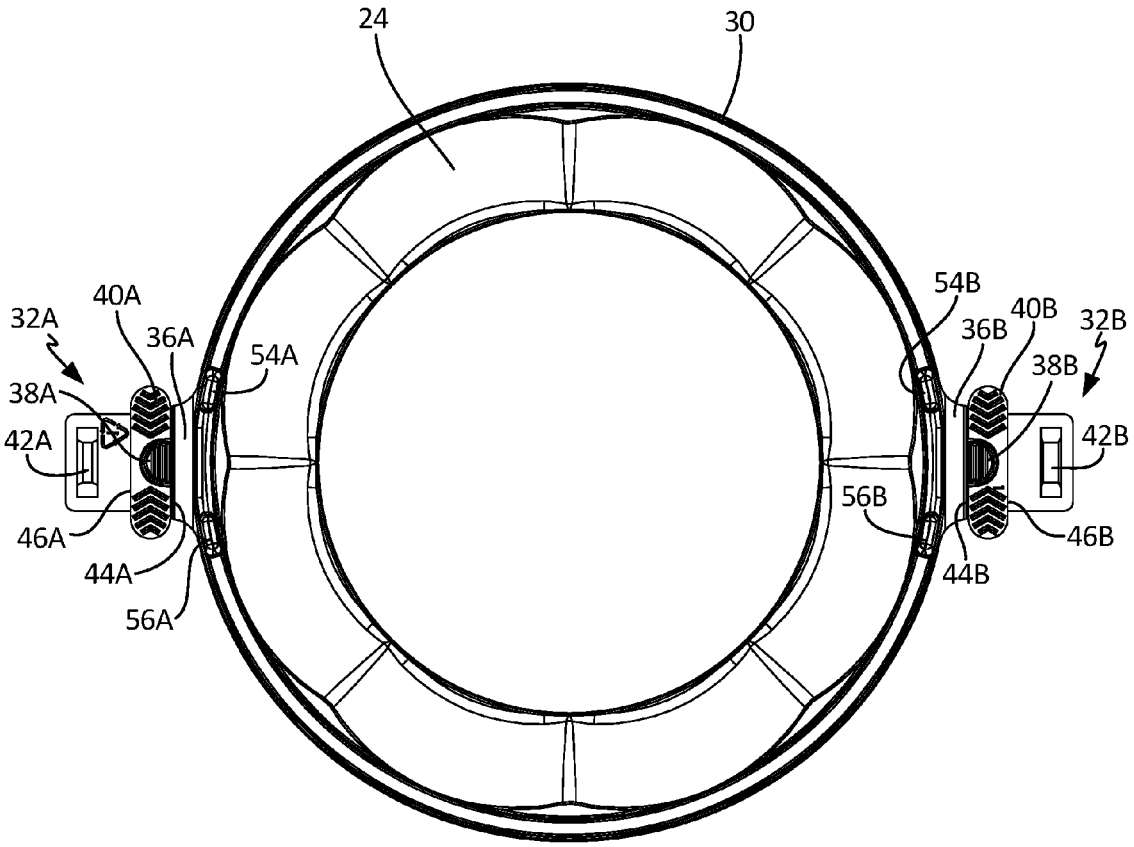
FIG. 3B is a top view of the second container portion of the tamper evident container.

FIGS. 2A-3B show tamper evident container 20. FIG. 2A is an isometric view of first container portion 22 of tamper evident container 20. FIG. 2B is an isometric view of second container portion 24 of tamper evident container 20. FIG. 3A is a top view of first container portion 22 of tamper evident container 20. FIG. 3B is a top view of second container portion 24 of tamper evident container 20. Tamper evident container 20 includes first container portion 22, second container portion 24, rim 26, undercuts 28, rim 30, tamper evident closure 32A, and tamper evident closure 32B. Tamper evident closure 32A includes first snap 34A, flange 36A, tab 38A, tear strip 40A, second snap 42A, perforated line 44A, perforated line 46A, projection 48A, tab 50A, tab 52A, projection 54A, and projection 56A. Tamper evident closure 32B includes first snap 34B, flange 36B, tab 38B, tear strip 40B, second snap 42B, perforated line 44B, perforated line 46B, projection 48B, tab 50B, tab 52B, projection 54B, and projection 56B. Container 20 includes first container portion 22 that forms a base of container 20 and second container portion 24 that forms a cover of container 20. First container portion 22 includes rim 26 at an upper edge. Positioned around rim 26 are undercuts 28. Undercuts 28 project inwards towards a center of first container portion 22. Second container portion 24 includes rim 30 at a lower edge. Rim 30 includes a flange that extends outward from second container portion 24. Rim 30 of second container portion 24 is sized slightly smaller than rim 26 of first container portion 22 so that rim 30 of second container portion 24 can be positioned in rim 26 of first container portion 22. Undercuts 28 on rim 26 engage rim 30 to retain second container portion 24 on first container portion 22. To remove second container portion 24 from first container portion 22, rim 26 of first container portion 22 can be pulled away from rim 30 of second container portion 24 to disengage undercuts 28 from rim 30 to allow second container portion 24 to be removed from first container portion 22.

Container 20 further includes tamper evident closures 32A and 32B. Tamper evident closures 32A and 32B further hold container 20 in a closed position. Tamper evident closures 32A and 32B are located on opposite sides of tamper evident container 20. In alternate embodiments, tamper evident closures 32A and 32B may be located anywhere on container 20. In further alternate embodiments, container 20 can include a single tamper evident closure or more tamper evident closures.

First container portion 22 includes first snaps 34A and 34B and second container portion 24 includes flanges 36A and 36B, tabs 38A and 38B, tear strips 40A and 40B, and second snaps 42A and 42B. First container portion 22 is integrally formed with first snaps 34A and 34B. Second container portion 24 is integrally formed with flanges 36A and 36B and tabs 38A and 38B. Flanges 36A and 36B and tabs 38A and 38B are attached to tear strips 40A and 40B along perforated lines 44A and 44B, respectively. Second snaps 42A and 42B are attached to tear strips 40A and 40B along perforated lines 46A and 46B, respectively.

First snaps 34A and 34B have a substantially rectangular shape and project upwards from first container portion 22. First snaps 34A and 34B have a cavity formed on the inside of the upward projection that can be accessed on the bottom side of first container portion 22. Second snaps 42A and 42B have a substantially rectangular shape and project downwards from second container portion 24. Second snaps 42A and 42B have a cavity formed on the inside of the downward projection that can be accessed on the top side of second container portion 24. Tamper evident closures 32A and 32B are formed by fitting second snaps 42A and 42B in the cavities of first snaps 34A and 34B, respectively. In alternate embodiments, first snaps 34A and 34B and second snaps 42A and 42B can have any shape, including but not limited to, a square shape, a circular shape, or an oval shape. Further, first snaps 34A and 34B and second snaps 42A and 42B can extend in any suitable direction and tamper evident closures 32A and 32B can have snaps with reversed orientation. In further alternate embodiments, first snaps 34A and 34B can be openings in first container portion 22.

Flanges 36A and 36B extend away from second container portion 24. Tabs 38A and 38B are integrally formed with flanges 36A and 36B, respectively. Tabs 38A and 38B have a semi-circle shape that extends away from flanges 36A and 36B. Perforated lines 44A and 44B abut flanges 36A and 36B and tabs 38A and 38B, respectively. Perforated lines 44A and 44B and perforated lines 46A and 46B can be made from perforations of any suitable size. Tear strips 40A and 40B have a narrow middle section with bigger tabs on opposite ends of the narrow middle section where tear strips 40A and 40B abut tabs 38A and 38B, respectively. Tear strips 40A and 40B also extend outward on a first side and a second side of flanges 36A and 36B, which make it easy for a user to grasp tear strips 40A and 40B on either end to pull tear strips 40A and 40B away from container 20. In alternate embodiments, tear strips 40A and 40B can have alternate shapes and sizes.

First container portion 22 also includes projections 48A and 48B that are integrally formed with first container portion 22. Projections 48A and 48B are U-shaped projections that extend around three sides of first snaps 34A and 34B, respectively, and form a cavity on a top side of first container portion 22. In alternate embodiments, projections 48A and 48B can by any suitable shape. First container portion 22 also includes tabs 50A and 50B and tabs 52A and 52B that are integrally formed with first container portion 22. Tabs 50A and 50B are positioned on a first side of projections 48A and 48B, respectively, and tabs 52A and 52B are positioned on a second side of projections 48A and 48B, respectively.

Second container portion 24 also includes projections 54A and 54B and projections 56A and 56B. Projections 54A and 54B and projections 56A and 56B extend downward from second container portion 24 and a cavity is formed on a top side of projections 54A and 54B and projections 56A and 56B. Projections 54A and 54B are positioned on a first side of flanges 36A and 36B, respectively, and projections 56A and 56B are positioned on a second side of flanges 36A and 36B, respectively. When container 20 is in a closed position, projections 54A and 54B are positioned in projections 48A and 48B on a first side of first snaps 34A and 34B, respectively, and projections 56A and 56B are positioned in projections 48A and 48B on a second side of first snaps 34A and 34B, respectively. Projections 54A and 54B and projections 56A and 56B help positioned second container portion 24 on first container portion 22 in this manner.

As seen in FIG. 1, when tamper evident container 20 is in a closed position, tamper evident closures 32A and 32B are positioned so that tear strips 40A and 40B face away from tamper evident closures 32A and 32B, respectively. To open tamper evident container 20, a user can grab tear strips 40A and 40B between his/her fingers and pull it away from tamper evident container 20. Tear strips 40A and 40B are attached to flanges 36A and 36B and tabs 38A and 38B along perforated lines 44A and 44B, respectively, and to second snaps 42A and 42B along perforated lines 46A and 46B, respectively. When tear strips 40A and 40B are pulled away from tamper evident container 20, perforated lines 44A and 44B and perforated lines 46A and 46B separate so that tear strips 40A and 40B can be removed from tamper evident container 20. Once tear strips 40A and 40B are removed, second container portion 24 can be removed from first container portion 22 to open tamper evident container 20. A user can grasp tabs 38A and 38B, tabs 50A and 50B, and tabs 52A and 52B to open tamper evident container 20.

Tamper evident container 20 is manufactured as two separate pieces. Tamper evident container 20 is manufactured using common container and packaging manufacturing techniques. Manufacturing tamper evident container 20 as two separate pieces allows multiple first container portions 22 to be stacked in a substantially flat manner for shipping and it allows multiple second container portions 24 to be stacked in a substantially flat manner for shipping. This allows multiple containers to be shipped in a single box, which saves space and cost. Being able to stack tamper evident container 20 in two separate stacks of first container portions 22 and second container portions 24 also saves space when storing tamper evident container 20.

Tamper evident closures 32A and 32B create a container that is tamper evident. To open tamper evident container 20, a user must grab tear strips 40A and 40B and pull them away and remove them from tamper evident container 20. When tear strips 40A and 40B have been removed and thus no longer present on tamper evident container 20, a user knows that tamper evident container 20 has been opened. A user can open and close tamper evident container 20 by attaching and detaching second container portion 24 from first container portion 22 using rim 26 and undercuts 28 on first container portion 22 and rim 30 on second container portion 24. Tamper evident container 20 can be opened and closed an infinite number of times, even though tamper evident container 20 will no longer have tamper evident features after it is opened for the first time.

Tamper evident closures 32A and 32B are simple and intuitive to use. This makes tamper evident closures 32A and 32B advantageous, as users do not need to be trained or instructed on how to use tamper evident closures 32A and 32B. Tamper evident container 20 can be assembled by hand, which allows someone to use the container to package his or her own products. Tamper evident container 20 can also be assembled automatically, thus making tamper evident container 20 suitable for use in large manufacturing operations. Tamper evident container 20 can be used in a variety of different ways. First, tamper evident container 20 can be used to package food. Having a tamper evident package for food is advantageous, as consumers can ensure that the food has not been tampered with prior to purchasing it. Second, tamper evident container 20 can be used to package products. Having a tamper evident package for products can ensure consumers that all of the parts are in the package and that the product has not been tampered with prior to purchasing it.

Figure 4:
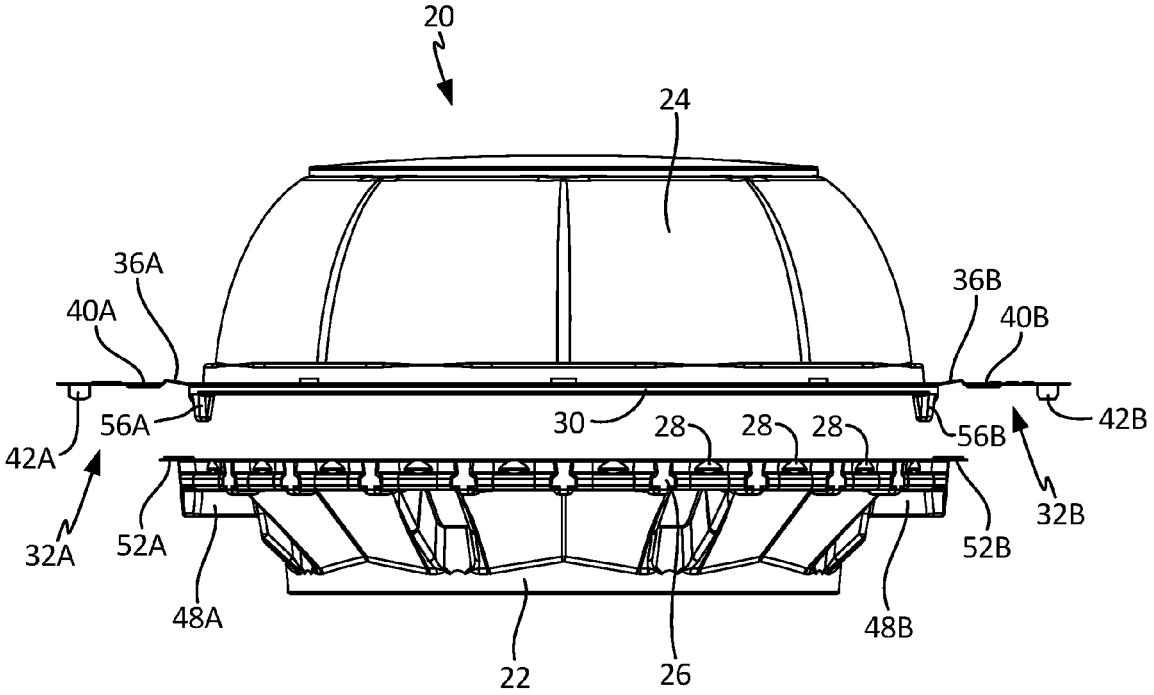
FIG. 4 is a front view of the second container portion of the tamper evident container being positioned on the first container portion of the tamper evident container.

FIG. 4 is a front view of second container portion 24 of tamper evident container 20 being positioned on first container portion 22 of tamper evident container 20. Tamper evident container 20 includes first container portion 22, second container portion 24, rim 26, undercuts 28, rim 30, tamper evident closure 32A, and tamper evident closure 32B. Tamper evident closure 32A includes first snap 34A, flange 36A, tab 38A, tear strip 40A, second snap 42A, perforated line 44A, perforated line 46A, projection 48A, tab 50A, tab 52A, projection 54A, and projection 56A. Tamper evident closure 32B includes first snap 34B, flange 36B, tab 38B, tear strip 40B, second snap 42B, perforated line 44B, perforated line 46B, projection 48B, tab 50B, tab 52B, projection 54B, and projection 56B.

Container 20 includes first container portion 22 and second container portion 24. When second container portion 24 is positioned on first container portion 22, rim 30 of second container portion 24 is aligned with rim 26 of first container portion 22. Rim 30 of second container portion 24 will form a seal with rim 26 of first container portion 22 when second container portion 24 is fully positioned on first container portion 22. Undercuts 28 on rim 26 of first container portion 22 will engage rim 30 of second container portion 24 to hold second container portion 24 on first container portion 22 to close container 20.

Further, when second container portion 24 is positioned on first container portion 22, projections 54A and 54B (not shown in FIG. 4) and projections 56A and 56B on second container portion 24 are aligned with projections 48A and 48B on first container portion 22. Projections 54A and 54B are positioned on a first side of first snaps 34A and 34B in projections 48A and 48B, respectively, and projections 56A and 56B are positioned on a second side of first snaps 34A and 34B in projections 48A and 48B, respectively.

When second container portion 24 is positioned on first container portion 22, a user can still remove second container portion 24 from first container portion 22 by pulling rim 26 of first container portion 22 away from rim 30 of second container portion 24 to disengage undercuts 28 from rim 30 to allow second container portion 24 to be removed from first container portion 22. Rim 26 of first container portion 22 can be pulled away from rim 30 of second container portion 24 by grasping one of tabs 50A and 50B or tabs 52A and 52B. In this position, tamper evident container 20 can be used as a regular container with no tamper evident features.

Figure 5A:
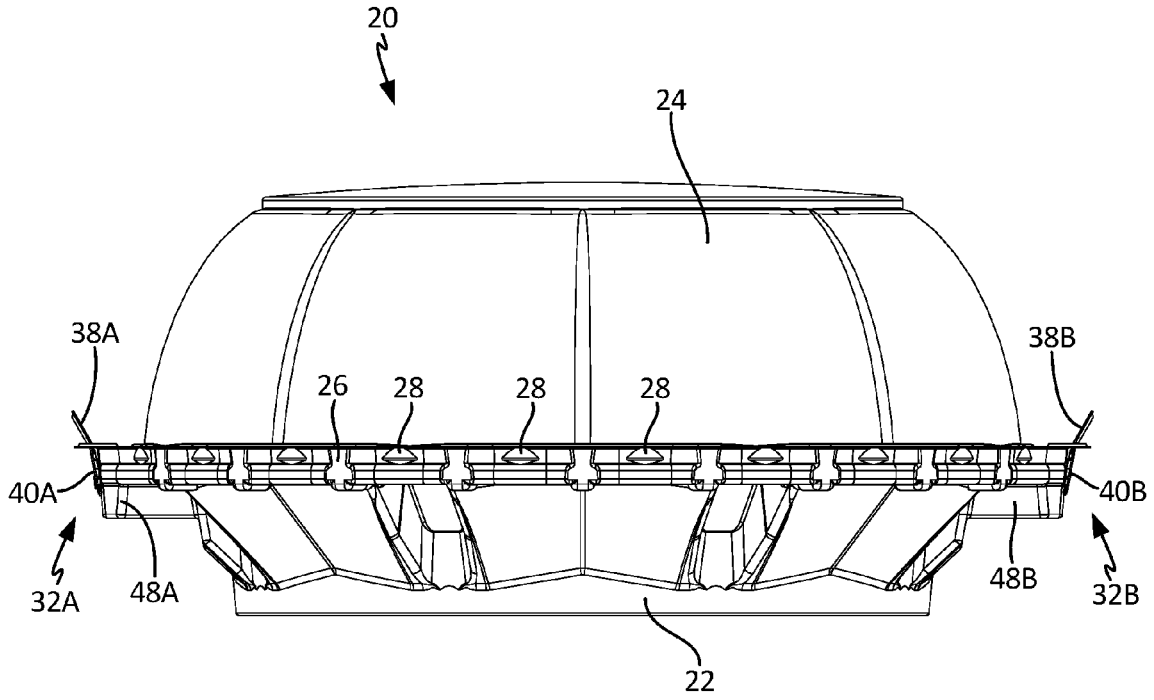
FIG. 5A is a front view of the tamper evident container when tamper evident closures have been closed.
Figure 5B:
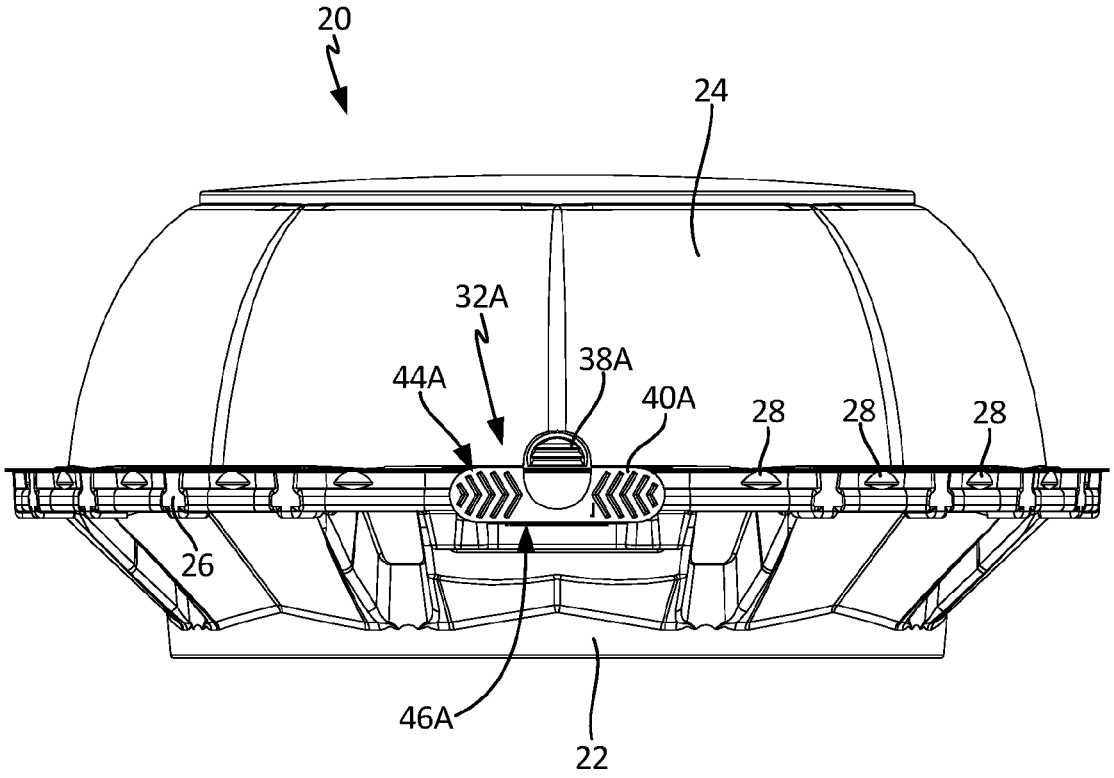
FIG. 5B is a side view of the tamper evident container when the tamper evident closure has been closed.
Figure 6:
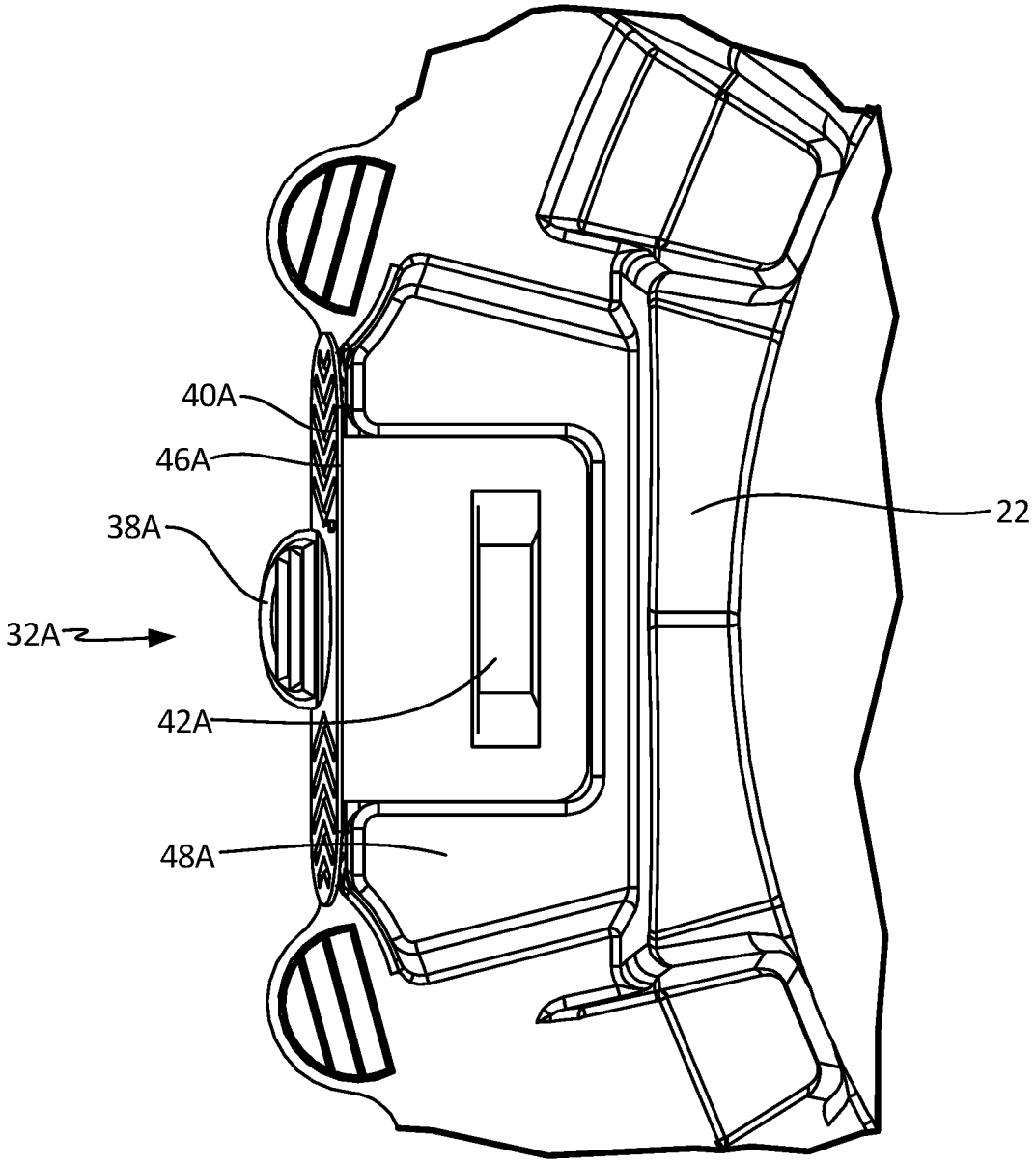
FIG. 6 is a cut-away bottom view of the tamper evident closure.

FIGS. 5A-6 show container 20 when tamper evident closures 32A and 32B have been closed. FIG. 5A is a front view of tamper evident container 20 when tamper evident closures 32A and 32B have been closed. FIG. 5B is a side view of tamper evident container 20 when tamper evident closure 32A has been closed. FIG. 6 is a cut-away bottom view of tamper evident closure 32A. Tamper evident container 20 includes first container portion 22, second container portion 24, rim 26, undercuts 28, rim 30, tamper evident closure 32A, and tamper evident closure 32B. Tamper evident closure 32A includes first snap 34A, flange 36A, tab 38A, tear strip 40A, second snap 42A, perforated line 44A, perforated line 46A, projection 48A, tab 50A, tab 52A, projection 54A, and projection 56A. Tamper evident closure 32B includes first snap 34B, flange 36B, tab 38B, tear strip 40B, second snap 42B, perforated line 44B, perforated line 46B, projection 48B, tab 50B, tab 52B, projection 54B, and projection 56B.

To fully close tamper evident container 20, second snaps 42A and 42B are folded and placed in the cavity of first snaps 34A and 34B, respectively. As second snaps 42A and 42B are folded, tear strips 40A and 40B are folded along perforation lines 44A and 44B, respectively, so that tear strips 40A and 40B face outward from tamper evident container 20. When tear strips 40A and 40B are folded along perforation lines 44A and 44B, the portion of perforation lines 44A and 44B that abuts tabs 38A and 38B can separate. Tabs 38A and 38B will then extend outward from tamper evident container 20. A user can fold tabs 38A and 38B upwards to make tabs 38A and 38B easy to grasp, as seen in FIG. 5A.

Second snaps 42A and 42B are further folded along perforation lines 46A and 46B, so that second snaps 42A and 42B project upwards and can fit into the cavities of first snaps 34A and 34B, respectively. When tamper evident closures 32A and 32B are closed, tear strips 40A and 40B face outward from tamper evident container 20. To remove tear strips 40A and 40B, a user can grasp either end of tear strips 40A and 40B and pull tear strips 40A and 40B away from tamper evident container 20. When tear strips 40A and 40B are pulled away from tamper evident container 20, perforated lines 44A and 44B and perforated lines 46A and 46B will separate and break apart. This allows for the easy removal of tear strips 40A and 40B. Once tear strip is removed, tamper evident container 20 can be opened and closed as normal. Second snaps 42A and 42B remain in the cavity of first snaps 34A and 34B when tamper evident container 20 is opened after tear strips 40A and 40B have been removed.

Second snaps 42A and 42B are designed to fit tightly in first snaps 34A and 34B with no voids so that tamper evident container 20 cannot be opened without first removing tear strips 40A and 40B. The tight fit between second snaps 42A and 42B and first snaps 34A and 34B, respectively, reduces the potential of someone being able to open the container with a sharp or pointed object. It also reduces the potential of someone being able to open tamper evident container 20 without first removing tear strips 40A and 40B.

Further, as shown in FIG. 6, when second snaps 42A and 42B are folded and placed in first snaps 34A and 34B, projections 48A and 48B surround three edges of second snaps 42A and 42B, respectively. Projections 48A and 48B prevent a user from prying second snaps 42A and 42B out of first snaps 34A and 34B, as it is very difficult, if not impossible, to grasp an edge of second snaps 42A and 42B. Further, even if a user were able to grasp an edge of second snaps 42A and 42B, perforated lines 46A and 46B would tear when trying to remove second snaps 42A and 42B from first snaps 34A and 34B. This would indicate to a user that someone has tampered with container 20. In the embodiment shown, projections 48A and 48B are U-shaped projections that surround three edges of second snaps 42A and 42B, however in alternate embodiments projections 48A and 48B can have any shape that surrounds the edges of second snaps 42A and 42B.

Tamper evident closures 32A and 32B are closures that can be closed for the first time by a user to create a tamper evident seal. After it is opened for the first time and tear strips 40A and 40B are removed, tamper evident container 20 can be opened and closed an infinite number of times using rim 26 and undercuts 28 of first container portion 22 and rim 30 of second container portion 24. Tamper evident closures 32A and 32B are advantageous for this reason, as they allow a user to utilize a tamper evident closure on a container while allowing the container to be opened and closed an infinite number of times after it is opened for the first time. Tamper evident container 20 is permanently altered when tear strips 40A and 40B are removed, but the permanent alteration does not prevent a user from opening and closing container 20 after that point.

In the embodiment shown, tamper evident container 20 is a two-piece container with first container portion 22 and second container portion 24. In alternate embodiments, tamper evident container 20 can be a clamshell container, with the first container portion connected to the second container portion along a hinge. Further, in alternate embodiments, the number of tamper evident closures can vary and can include more than one tamper evident closure. Additionally, the size, shape, and placement of the tamper evident closures can vary depending on the structure of the container.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A tamper evident closure comprising:
   - a first snap that is configured to be attached to a first container portion;
   - a tear strip that is configured to be attached to a second container portion that is configured to be removed from the tamper evident closure;
   - a second snap connected to the tear strip; and
   - a first projection extending around three sides of the first snap;
   - wherein in a closed position, the second snap is positioned in a cavity of the first snap;
   - wherein in a closed position, the first projection surrounds three sides of the second snap that is positioned in the cavity of the first snap; and
   - wherein when the tear strip is removed, the second snap remains in the first snap on the first container portion and there are no snaps on the second container portion.

2. The tamper evident closure of claim 1, and further comprising:
   - a flange with a first side connected to the tear strip and a second side that is configured to be connected to the second container portion.

3. The tamper evident closure of claim 2, and further comprising:
   - a first perforated line connecting the second snap to the tear strip; and
   - a second perforated line connecting the tear strip to the flange.

4. The tamper evident closure of claim 3, wherein the tear strip is configured to be removed from the tamper evident closure by separating the tear strip along the first perforated line and the second perforated line.

5. The tamper evident closure of claim 1, wherein the second snap has a tight fit with the cavity of the first snap and cannot be removed from the cavity of the first snap.

6. A tamper evident container comprising:
a first container portion;
a second container portion; and
a tamper evident closure comprising:
a first snap connected to the first container portion;
a tear strip connected to the second container portion;
a second snap connected to the tear strip; and
a first projection extending around three sides of the first snap;
wherein in a closed position, the second snap is positioned in a cavity of the first snap;
wherein in a closed position, the first projection surrounds three sides of the second snap that is positioned in the cavity of the first snap; and
wherein when the tear strip is removed, the second container portion can be removed from the first container portion and the second snap remains in the first snap on the first container portion and there are no snaps on the second container portion.

7. The tamper evident container of claim 6, wherein the first container portion includes an upper rim and a plurality of undercuts on the upper rim, wherein each undercut extends inwards towards a center of the first container portion.

8. The tamper evident container of claim 7, wherein the second container portion includes a lower rim, wherein the lower rim of the second container portion seals against the rim of the first container portion and the undercuts of the first container portion engage the rim of the second container portion.

9. The tamper evident container of claim 6, and further comprising:
a first tab on a first side of the first snap; and
a second tab on a second side of the first snap;
wherein the first tab and the second tab are configured to be grasped by a user to open and close tamper evident container.

10. The tamper evident container of claim 6, and further comprising:
a flange with a first side connected to the tear strip and a second side connected to a container;
a first perforated line connecting the second snap to the tear strip; and
a second perforated line connecting the tear strip to the flange;
wherein the tear strip is configured to be removed from the tamper evident closure by separating the tear strip along the first perforated line and the second perforated line.

11. The tamper evident container of claim 10, and further comprising:
a second projection on a first side of the flange; and
a third projection on a second side of the flange;
wherein when the container is in a closed position, the second projection and the third projection are positioned in a cavity formed by the first projection.

12. The tamper evident container of claim 6, wherein the second snap has a tight fit with the cavity of the first snap and cannot be removed from the cavity of the first snap.

13. The tamper evident container of claim 6, wherein the first container portion and the second container portion are attached with a hinge.

14. The tamper evident container of claim 6, wherein the first container portion and the second container portion are two separate pieces.

15. A method comprising:
closing a tamper evident container by bringing a first container portion into contact with a second container portion, wherein the first container portion has a first snap and the second container portion has a flange, a tear strip attached to the flange along a first perforated line, and a second snap attached to the tear strip along a second perforated line;
folding the tear strip along the first perforated line;
folding the second snap along the second perforated line; and
placing the second snap in a cavity of the first snap, wherein when the second snap is in the cavity of the first snap, a projection in the first container portion surrounds three sides of the second snap;
removing the tear strip from the tamper evident container; and
removing the second container portion from the first container portion, wherein the second snap remains in the first snap on the first container portion and there are no snaps on the second container portion.

16. The method of claim 15, wherein closing the tamper evident container includes placing a rim of the second container portion against a rim of the first container portion, wherein undercuts in the rim of the first container portion engage the rim of the second container portion.

17. The method of claim 16, wherein removing the tear strip from the tamper evident container includes:
grasping a first end of the tear strip;
tearing the tear strip along the first perforated line and the second perforated line;
discarding the tear strip; and
opening the tamper evident container by separating the rim of the second container portion from the undercuts and the rim of the first container portion.

18. The method of claim 17, wherein opening the tamper evident container includes grasping a first tab on the first container portion to pull the rim of the first container portion away from the second container portion.

19. The method of claim 16, wherein when the tamper evident container is opened, the second snap remains in the cavity of the first snap.

20. The method of claim 15, wherein when the tamper evident container is closed, a second projection on a first side of the flange and a third projection on a second side of the flange are placed in a cavity in the first projection.

21. A tamper evident container comprising:
a first container portion;
a second container portion; and
a tamper evident closure comprising:
a first snap connected to the first container portion;
a flange connected to the second container portion;
a tear strip connected to the flange;
a second snap connected to the tear strip;
a first projection extending around three sides of the first snap;
a second projection on a first side of the flange; and
a third projection on a second side of the flange;
wherein in a closed position, the second snap is positioned in a cavity of the first snap;
wherein in a closed position, the first projection surrounds three sides of the second snap that is positioned in the cavity of the first snap; and
wherein in a closed position, the second projection and the third projection are positioned in a cavity formed by the first projection.

22. The tamper evident container of claim 21, wherein the first container portion includes an upper rim and a plurality of undercuts on the upper rim, wherein each undercut extends inwards towards a center of the first container portion.

23. The tamper evident container of claim 22, wherein the second container portion includes a lower rim, wherein the lower rim of the second container portion seals against the rim of the first container portion and the undercuts of the first container portion engage the rim of the second container portion.

24. The tamper evident container of claim 21, and further comprising:

a first tab on a first side of the first snap; and a second tab on a second side of the first snap;

wherein the first tab and the second tab are configured to be grasped by a user to open and close tamper evident container.

25. The tamper evident container of claim 21, and further comprising:

a first perforated line connecting the second snap to the tear strip; and a second perforated line connecting the tear strip to the flange;

wherein the tear strip is configured to be removed from the tamper evident closure by separating the tear strip along the first perforated line and the second perforated line.

26. The tamper evident container of claim 21, wherein the second snap has a tight fit with the cavity of the first snap and cannot be removed from the cavity of the first snap.

27. A method comprising:

closing a tamper evident container by bringing a first container portion into contact with a second container portion, wherein the first container portion has a first snap and the second container portion has a flange, a tear strip attached to the flange along a first perforated line, and a second snap attached to the tear strip along a second perforated line;

folding the tear strip along the first perforated line;

folding the second snap along the second perforated line; and placing the second snap in a cavity of the first snap, wherein when the second snap is in the cavity of the first snap, a projection in the first container portion surrounds three sides of the second snap, and wherein when the tamper evident container is closed, a second projection on a first side of the flange and a third projection on a second side of the flange are placed in a cavity in the first projection.

28. The method of claim 27, wherein closing the tamper evident container includes placing a rim of the second container portion against a rim of the first container portion, wherein undercuts in the rim of the first container portion engage the rim of the second container portion.

29. The method of claim 16, and further comprising:

grasping a first end of the tear strip;

tearing the tear strip along the first perforated line and the second perforated line;

discarding the tear strip; and opening the tamper evident container by separating the rim of the second container portion from the undercuts and the rim of the first container portion.

30. The method of claim 29, wherein opening the tamper evident container includes grasping a first tab on the first container portion to pull the rim of the first container portion away from the second container portion.

31. The method of claim 27, wherein when the tamper evident container is opened, the second snap remains in the cavity of the first snap.

* * * * *